US005648748A

United States Patent [19]

Isida

[11] Patent Number: 5,648,748

[45] Date of Patent: Jul. 15, 1997

[54] IMPEDANCE CONVERTING DEVICE CAPABLE OF READILY ADJUSTING AN IMPEDANCE CONVERTING CHARACTERISTIC WITH AN ELECTROMAGNETIC SHIELDING EFFECT

[75] Inventor: Masatosi Isida, Tokyo, Japan

[73] Assignee: NEC Corporation, Tokyo, Japan

[21] Appl. No.: 544,872

[22] Filed: Oct. 18, 1995

[30] Foreign Application Priority Data

Oct. 18, 1994 [JP] Japan ..... 6-252365

[51] Int. Cl.[6] ..... H01P 5/04

[52] U.S. Cl. ..... 333/246; 333/263

[58] Field of Search ..... 333/33, 204, 205, 333/238, 246, 263

[56] References Cited

U.S. PATENT DOCUMENTS

| | | | |
|---|---|---|---|
| 2,896,177 | 7/1959 | Wilson | 333/33 |
| 2,915,716 | 12/1959 | Hattersley | 333/204 |
| 3,359,513 | 12/1967 | Kelley | 333/161 |
| 3,656,179 | 4/1972 | De Loach | 333/161 |
| 3,961,296 | 6/1976 | Wiggenhorn | 333/238 |
| 4,575,697 | 3/1986 | Rao et al. | 333/157 |
| 5,304,966 | 4/1994 | Hino et al. | 333/204 |

FOREIGN PATENT DOCUMENTS

| | | | |
|---|---|---|---|
| 2444228 | 3/1976 | Germany | 333/238 |
| 4120625 | 12/1992 | Germany . | |
| 62-268202 | 11/1987 | Japan . | |

OTHER PUBLICATIONS

*Handbook of Tri–Plate Microwave Components*, Sanders Associates., Nashua, N.H 1956, pp. 115, 117 & title page cited, TK7870S3, copy in AU.2502.

*Primary Examiner*—Paul Gensler

*Attorney, Agent, or Firm*—Sughrue, Mion, Zinn, Macpeak & Seas

[57] ABSTRACT

An impedance converting device comprises a tri-plate structure having a first grounded conductor member (21) a second grounded conductor member (22) located apart from the first grounded conductor member to form a space between the first and the second grounded conductor members, and a line conductor member (23) located in the space for allowing a signal to pass therethrough. The impedance converting device comprises a varying section (31 to 37) for varying a terminative condition of the electric flux generated from the line conductor member. The varying section may be a window section (31 to 34) formed in the second grounded conductor member at a predetermined location. The varying section may include a metal portion (35, 36) and a slave window section (37). The window section is partially covered with the metal portion. The slave window section is connected to the window section.

14 Claims, 5 Drawing Sheets

IMPEDANCE CONVERTING DEVICE CAPABLE OF READILY ADJUSTING AN IMPEDANCE CONVERTING CHARACTERISTIC WITH AN ELECTROMAGNETIC SHIELDING EFFECT

BACKGROUND OF THE INVENTION

This invention relates to an impedance converting device and, more particularly, to an impedance converting device having a tri-plate structure.

Impedance converting devices which comprise a microstrip line are generally known. An impedance converting device having a microstrip line will be called a first impedance converting device.

The first impedance converting device comprises a grounded conductor member and a dielectric member located on the grounded conductor member. A microstrip line is formed on the dielectric member as a line conductor member which allows a signal to pass therethrough. The microstrip line has an open stub line including an impedance converting section having an inductive reactance element and a capacitive reactance element. Furthermore, at least one metal portion may be attached to the microstrip line in order to adjust the reactance of the impedance converting section.

However, an electromagnetic wave is inevitably irradiated from the microstrip line to outside of the impedance converting device on the basis of a high frequency signal passing through the microstrip line since nothing is located above the microstrip line in the first impedance converting device. In addition, an electromagnetic wave may be applied from outside of the impedance converting device to the microstrip line. In order to shield the electromagnetic wave, it is necessary to cover the first impedance converting device with a metal cover. As a result, the first impedance converting device becomes large. Furthermore, the metal cover affects the high frequency characteristics of the microstrip line.

On the other hand, an impedance converting device is known which comprises a strip line. This impedance converting device having a strip line will be called a second impedance converting device.

The second impedance converting device is disclosed in Japanese Unexamined Publication Tokkai Sho 62-268202 (268202/1987). The second impedance converting device comprises a tri-plate structure having first and second grounded conductor members and a strip line which is located in a space formed between the first and the second grounded conductor members. The strip line may be called the line conductor member in the second impedance converting device. The strip line is supported by a dielectric member inserted in the space. The strip line comprises an impedance converting section having an inductive reactance element and a capacitive reactance element.

Since the strip line is located in the space formed by the first and the second grounded conductor members, it is possible for the second impedance converting device to shield an electromagnetic wave. In other words, the second impedance converting device has an electromagnetic shielding effect.

However, it is difficult to vary the reactance of the impedance converting section in the second impedance converting device because the strip line is located in the space formed by the first and the second grounded conductor members. Thus, it is difficult to vary the impedance converting characteristics of the second impedance converting device.

SUMMARY OF THE INVENTION

It is therefore an object of this invention to provide an impedance converting device capable of readily varying an impedance converting characteristic with an electromagnetic shielding effect.

To accomplish the above object, an impedance converting device is provided comprising a tri-plate structure having a first grounded conductor member, a second grounded conductor member apart from the first grounded conductor member so as to form a space between the first and the second grounded conductor members, and a line conductor member located in the space for allowing a signal to pass therethrough. The line conductor member generates electric flux in accordance with the signal.

According to this invention, the impedance converting device comprises varying means for varying a terminative condition of the electric flux.

DESCRIPTION OF THE PREFERRED EMBODIMENTS

Figure 1:
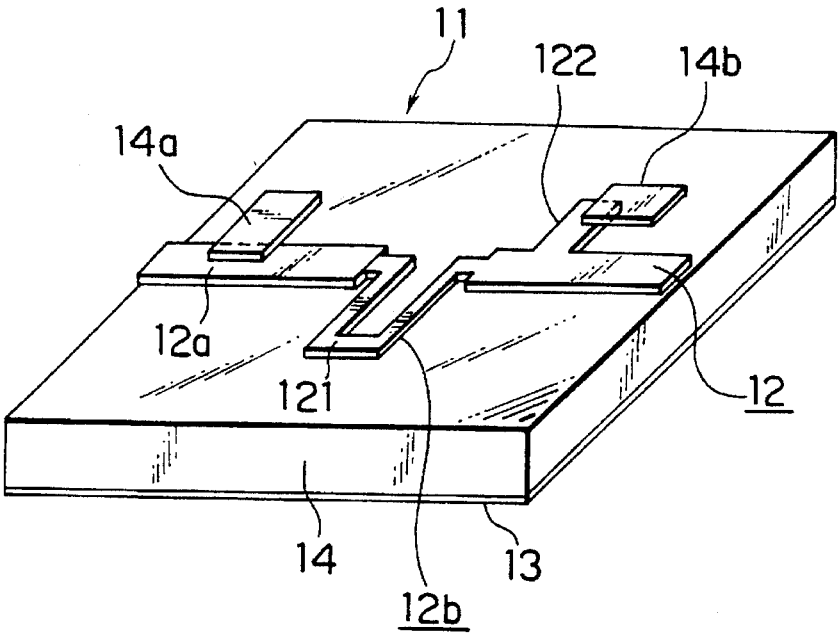
PRIOR ART FIG. 1
FIG. 1 shows a perspective view of a first conventional impedance converting device having a microstrip line.

Referring to FIG. 1, a description will first be given of a first conventional impedance converting device for a better understanding of this invention. The illustrated impedance converting device 11 comprises a microstrip line 12 which has a line conductor portion. The microstrip line 12 has a transmission line 12*a* and an open stub line 12*b*. The open stub line 12*b* has an impedance converting section which comprises an inductive reactance element 121 and a capacitive reactance element 122.

The impedance converting device further comprises a grounded conductor member 13 and a dielectric member 14 located on the grounded conductor member 13. The microstrip line 12 is formed on the dielectric member 14.

In the example being illustrated, metal portions 14*a* and 14*b* are attached to the microstrip line 12 on the dielectric member 14 in order to create a desired impedance converting characteristic in the impedance converting device 11.

However, an electromagnetic wave is inevitably irradiated from the microstrip line 12 to outside of the impedance converting device 11 on the basis of a high frequency signal passing through the microstrip line 12 inasmuch as nothing is located above the microstrip line 12 in the impedance converting device 11. In addition, an electromagnetic wave may be applied from outside of the impedance converting device 11 to the microstrip line 12. In order to shield the electromagnetic wave, it is necessary to cover the impedance converting device 11 by a metal cover (not shown). As a result, the impedance converting device 11 becomes large. Furthermore, the metal cover affects the high frequency characteristics of the microstrip line 12.

Figure 2:
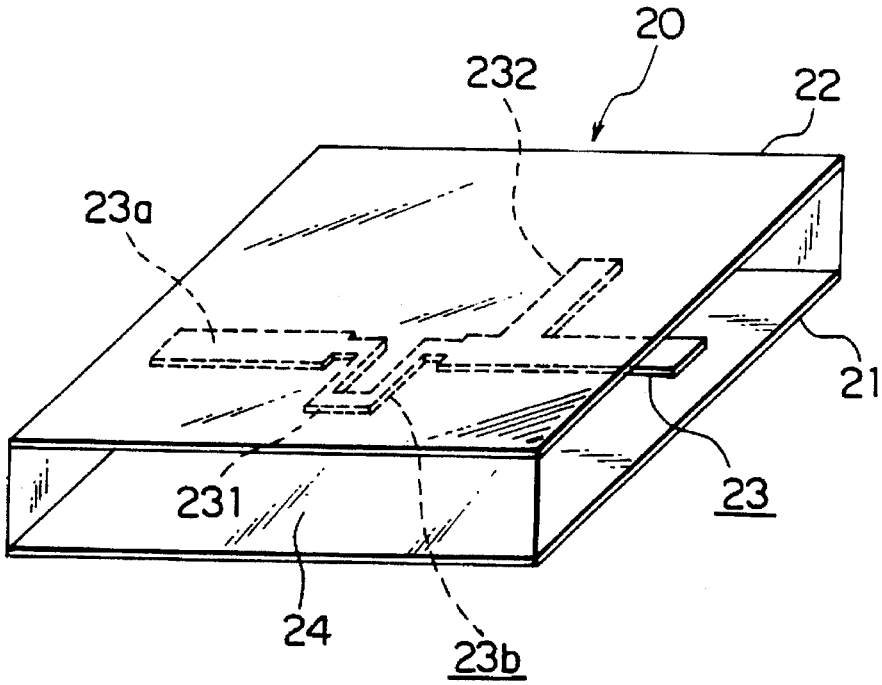
PRIOR ART FIG. 2
FIG. 2 shows a perspective view of a second conventional impedance converting device having a strip line.

Referring to FIG. 2, the description will proceed to a second conventional impedance converting device. The illustrated impedance converting device 20 comprises a tri-plate structure having first and second grounded conductor members 21 and 22 and a line conductor member 23.

The second grounded conductor member 22 is located apart from the first conductor member 21 to form a space between the first and the second grounded conductor members 21 and 22. The line conductor member 23 is located in the space and is supported by a dielectric member 24. The line conductor member 23 will be called a strip line which comprises a transmission line 23*a* and an impedance converting section 23*b* having an inductive reactance element 231 and a capacitive reactance element 232.

Since as the line conductor member 23 is located in the space formed by the first and the second grounded conductor members 21 and 22 in the impedance converting device 20, it is possible to shield electromagnetic waves. In other words, the impedance converting device 20 has an electromagnetic shielding effect.

However, it is difficult to vary or adjust the reactance of the impedance converting section 23*b* in the impedance converting device 20 inasmuch as the line conductor member 23 is located in the space formed by the first and the second grounded conductor members 21 and 22. Thus, it is difficult to adjust the impedance converting characteristics of the impedance converting device 20.

Figure 3A:
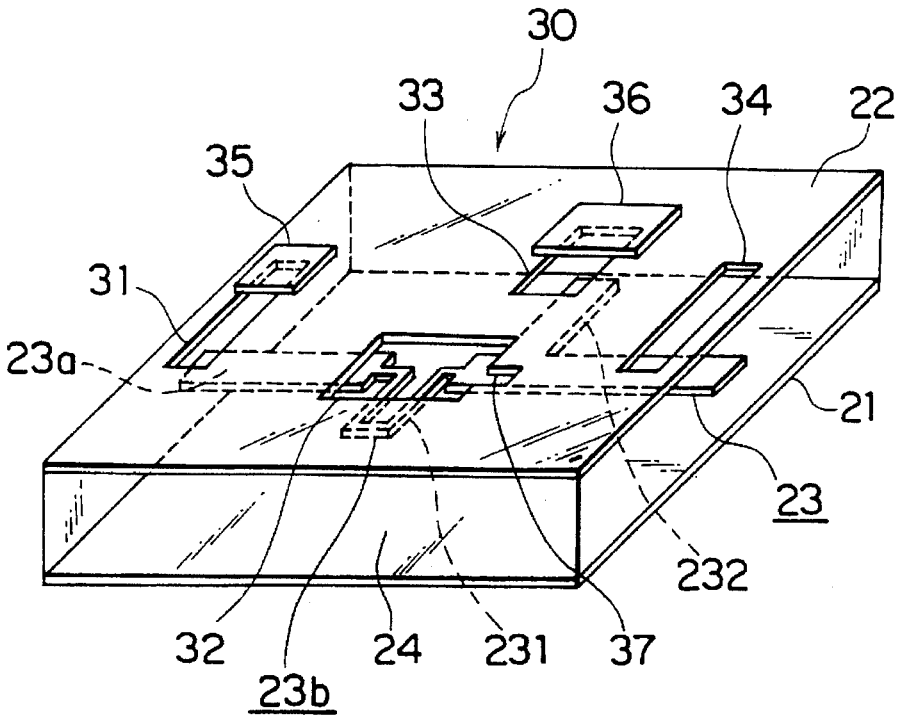
FIG. 3A shows a perspective view of an impedance converting device according to a first embodiment of this invention.
Figure 3B:
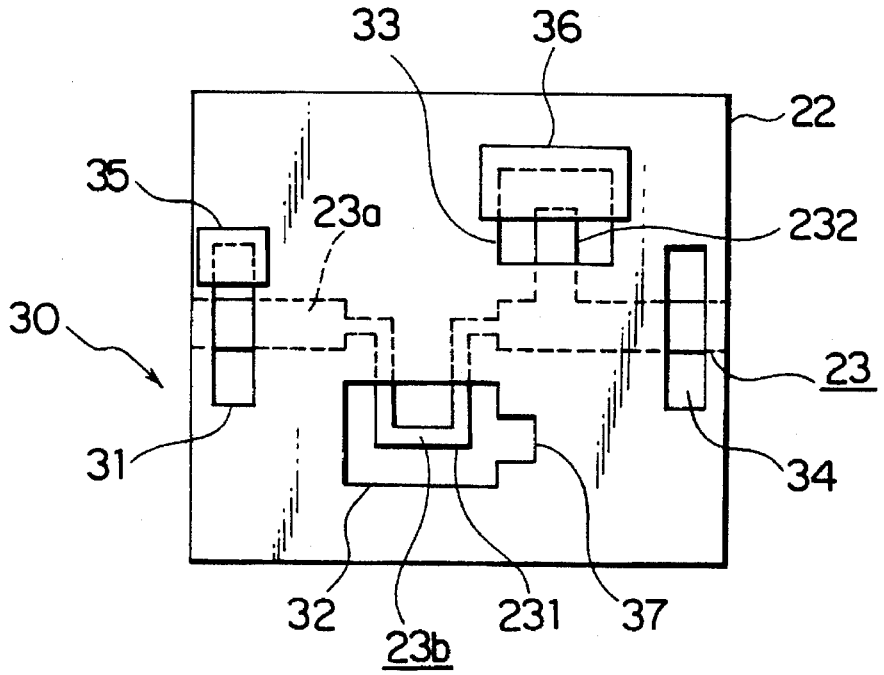
FIG. 3B shows a plan view of the impedance converting device illustrated in FIG. 3A.

Referring to FIGS. 3A and 3B, the description will proceed to an impedance converting device according to a first embodiment of this invention. The illustrated impedance converting device is different in structure from the impedance converting device 20 illustrated in FIG. 2 and is therefore designated afresh by a reference numeral 30. The impedance converting device 30 comprises similar parts which are designated by like references.

The impedance converting device 30 comprises a tri-plate structure having the first and second grounded conductor members 21 and 22 and line conductor member 23.

The second grounded conductor member 22 is located apart from the first conductor member 21 to form a space between the first and the second grounded conductor members 21 and 22. The line conductor member 23 is located in the space and is supported by the dielectric member 24.

In the example illustrated, the line conductor member 23 is located in the space. The dielectric member 24 fills up the space to support the line conductor member 23. The dielectric member 24 may be composed of at least two dielectric materials. In addition, the dielectric member 24 may occupy a part of the space. At any rate, the dielectric member 24 supports the line conductor member 23 in the space.

The line conductor member 23 will be called the strip line. In the example being illustrated, the line conductor member 23 comprises transmission line 23*a* and impedance converting section 23*b* having inductive reactance element 231 and a capacitive reactance element 232. The line conductor member 23 may have at least two impedance converting sections.

The impedance converting device 30 comprises at least one window section which is formed in at least one of the first and the second grounded conductor members 21 and 22. In the example being illustrated, the impedance converting device 30 comprises first through fourth window sections 31 to 34. More particularly, the first through the fourth window sections 31 to 34 are formed on the second grounded conductor member 22 in correspondence with the line conductor member 23. Each of the first and the fourth window sections 31 and 34 is formed on the second grounded conductor member 22 in correspondence to the transmission line 23*a*. The second window section 32 is formed on the second grounded conductor member 22 in correspondence to the inductive reactance element 231. The third window section 33 is formed on the second grounded conductor member 22 in correspondence to the capacitive reactance element 232. Each of the first through the fourth window sections 31 to 34 has a window form which may be, for example, a rectangular form.

As known in the art, an electromagnetic wave is inevitably generated from the line conductor member 23 in accordance with a high frequency signal which passes through the line conductor member 23. Specifically, the line conductor member 23 generates an electric flux in accordance with the high frequency signal. When the first through the fourth window sections 31 to 34 are formed on the second grounded conductor portion 22 as described above, a terminative condition of the electric flux is varied by the first through the fourth window sections 31 to 34. More particularly, a capacity is formed between the line conductor member 23 and the second grounded conductor member 22. The capacity is varied by the first through the fourth window sections 31 to 34. As a result, the reactance of the impedance converting section 23*b* is substantially varied as will be later described. Namely, it is possible to vary the impedance converting characteristics in the impedance converting device 30 by the first through the fourth window sections 31 to 34.

Now, it will be assumed that the first through the fourth window sections 31 to 34 has first through fourth open areas, respectively. The first through the fourth open areas may be different from one another. It is possible to vary each of the first through fourth open areas by additional or slave window sections or by a metal portion. In the example being illustrated, the first window sections 31 is partially covered with a first metal portion 35 so that the size of the first open area is reduced. Similarly, the third window sections 33 is partially covered with a second metal portion 36 so that the size of the third open area is reduced. On the other hand, the slave window sections 37 is formed on second grounded conductor member 22 and connected to the second window section 32. As a result, the second open area is made substantially larger.

As readily understood from the above description, it is possible to easily adjust the impedance converting characteristics of the impedance converting device 30 when the area of a window sections is varied by using a slave window or a metal portion.

Figure 4:
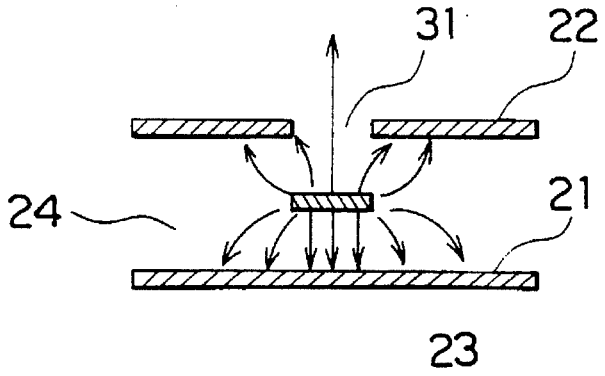
FIG. 4 shows a sectional view of the distribution of an electric field at a window of the impedance converting device illustrated in FIG. 3A.

Referring to FIGS. 4 to 7, the description will proceed to an electric field in the impedance converting device 30. In FIG. 4, attention will be directed to the first window sections 31. The electric flux designated by solid arrows is generated from the line conductor member 23 as described above. The electric flux mostly reaches to the first and the second grounded conductor members 21 and 22. The electric flux slightly passes through the first window sections 31. This means that the electric field is varied in the impedance converting device 30 by the first window Section 31. Similarly, the electric field is varied by each of the second through the fourth window sections 32 to 34 (FIG. 3A). As a result, the impedance converting characteristics are varied by the first through the fourth window sections 31 to 34. Because the amount of the electric flux which comes through the first through the fourth window sections 31 to 34 is small, the electromagnetic shielding effect is hardly deteriorated in the impedance converting device 30.

Figure 5:
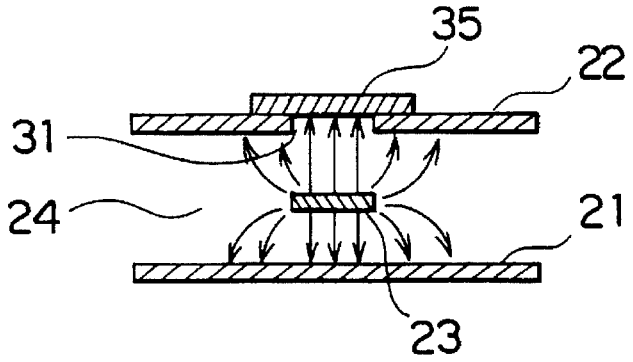
FIG. 5 shows a sectional view of the distribution of an electric field when a metal portion is located on the window illustrated in FIG. 3A.

In FIG. 5, attention will be directed to the first window section 31. The first window section 31 is partially covered with the first metal portion 35. As a result, the first open area of the first window section 31 is reduced, and a decrease occurs in the electric flux passing through the first window section 31. Therefore, it is possible to adjust the impedance converting characteristics of the impedance converting device 30 using the first metal portion 35.

Similarly, the third window section 33 is partially covered with the second metal portion 36. Using the second metal portion 36, the second open area of the third window section 33 can be reduced, thus decreasing the electric flux passing through the third window section 33. Therefore, it is possible to adjust the impedance converting characteristics of the impedance converting device 30 using the third metal portion 36.

Figure 6:
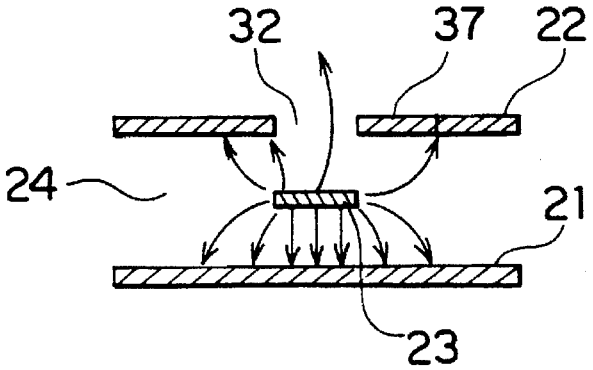
FIG. 6 shows a sectional view of the distribution of an electric field when an additional window is formed on the impedance converting device illustrated in FIG. 3A.

In FIG. 6, the second window sections 32 is connected to the slave window section 37 which is formed in the second grounded conductor member 22. By the slave window section 37, the second open area of the second window section 32 is substantially enlarged. The electric flux passes through the second window section 32 and the slave window section 37. Therefore, it is possible to adjust the impedance converting characteristics of the impedance converting device 30 using slave window section 37.

Figure 7:
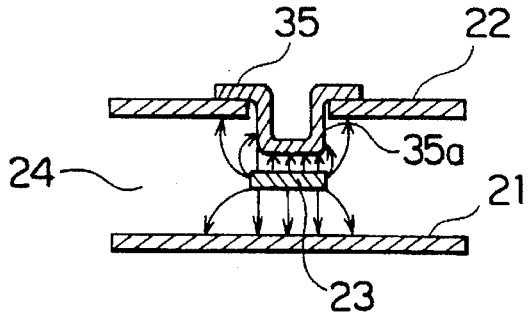
FIG. 7 shows a sectional view of the distribution of an electric when a metal portion is inserted in the window illustrated in FIG. 3A.

In FIG. 7, attention will be directed to the first window section 31. In the example being illustrated, the first metal portion 35 has a first projection portion 35*a*. The first projection portion 35*a* is inserted into the impedance converting device 30 through the first window section 31. In this case, the first window section 31 may be perfectly covered with the first metal portion 35. As shown in FIG. 7, the electric field is varied by the projection portion 35*a*. As a result, it is possible to adjust the impedance converting characteristics of the impedance converting device 30 by the first projection portion 35*a*. Although not illustrated the second metal portion may have a second projection portion which is inserted into the impedance converting device 30 through the third window section 33.

Figure 8:
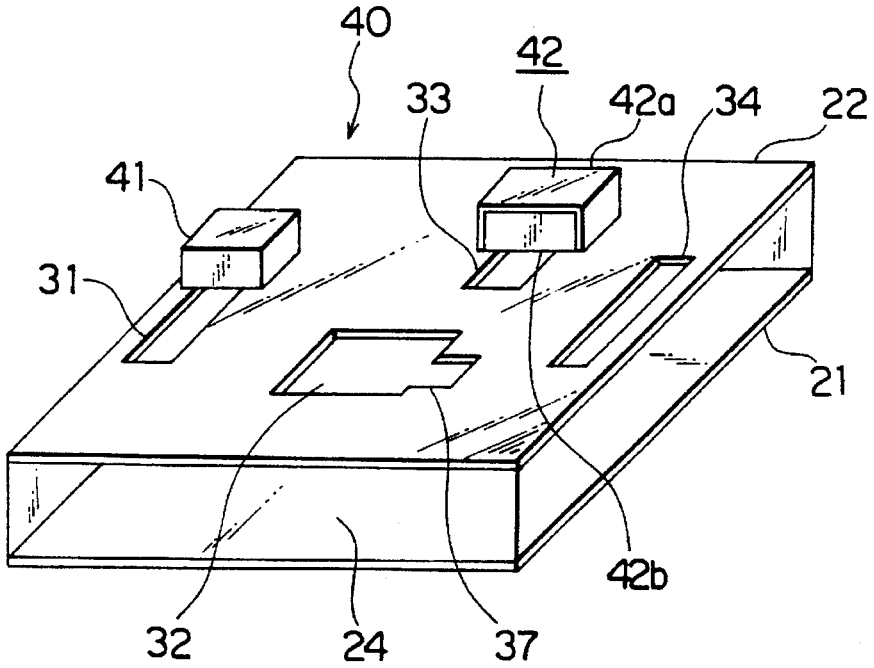
FIG. 8 shows a persepective view of an impedance converting device according to a second embodiment of this invention.

Referring to FIG. 8, description will proceed to an impedance converting device according to a second embodiment of this invention. Although the line conductor member is not illustrated in FIG. 8, the illustrated impedance converting device is similar in structure to the impedance converting device 30 illustrated in FIG. 3A except for the first and the second metal portions 35 and 36. In FIG. 8, the impedance converting device is designated afresh by a reference numeral 40. First and second dielectric bodies 41 and 42 are used instead of the first and the second metal portions 35 and 36 (FIG. 3A).

In the example being illustrated, the first window sections 31 is partially covered with the first dielectric body 41 composed of a dielectric material. The first open area of the first window section 31 is varied by the first dielectric body 41 in order to adjust the impedance converting characteristics of the impedance converting device 40. The first dielectric body 41 is a rectangular solid.

The third window section 33 is partially covered with a second dielectric body 42. The second dielectric body 42 is composed of a metal case 42*a* and a dielectric material 42*b* filling the metal case 42*a*. The metal case 42*a* is a rectangular solid and has at least one opening surface. As a result, the dielectric material 42*b* is exposed from the metal case 42*a* at the opening surface. In order to adjust the impedance converting characteristics of the impedance converting device 40, the third open area of the third window section 33 is varied by the second dielectric body 42. The opening surface of the metal case 42*a* faces the third window section 33.

Figure 9:
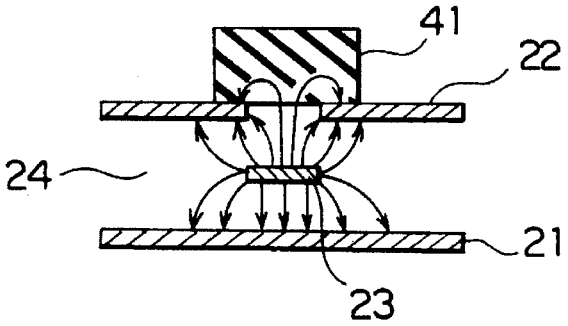
FIG. 9 shows a sectional view of the distribution of an electric field when a dielectric portion is located on the window illustrated in FIG. 8.

Referring to FIGS. 8 to 12, the description will proceed to an electric field in the impedance converting device 40. In FIG. 9, attention will be directed to the first window section 31. The first window section 31 is partially covered with the first dielectric body 41. As a result, the first open area of the first window section 31 is reduced, and a decrease occurs in the electric flux passing through the first window section 31. Furthermore, a part of the electric flux reaches the first dielectric body 41 and is terminated in the first dielectric body 41. Therefore, it is possible to adjust the impedance converting characteristics of the impedance converting device 40 by the first dielectric body 41.

The first window section 31 may be perfectly covered with the first dielectric body 41. In this case, the first dielectric body 41 terminates the electric flux passing through the first window section 31.

Figure 10:
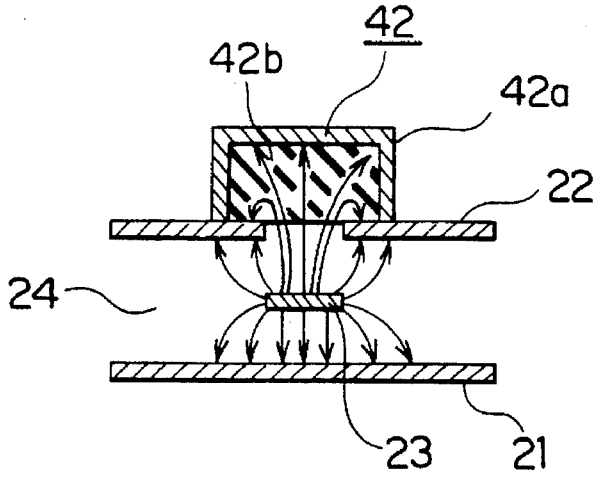
FIG. 10 shows a sectional view of the distribution of an electric field when a dielectric portion having a metal case is located on the window illustrated in FIG. 8.

In FIG. 10, attention will be directed to the third window sections 33. The third window section 33 is partially covered with the second dielectric body 42. As a result, the third open area of the third window section 33 is reduced, and a decrease occurs in the electric flux passing through the third window section 33. Furthermore, a part of the electric flux reaches the second dielectric body 42 to be terminated in the second dielectric body 42. Therefore, it is possible to adjust the impedance converting characteristics of the impedance converting device 40 by the second dielectric body 42.

The third window section 33 may be completely covered with the second dielectric body 42. In this case, the second dielectric body 42 terminates the electric flux passing through the third window section 33.

Figure 11:
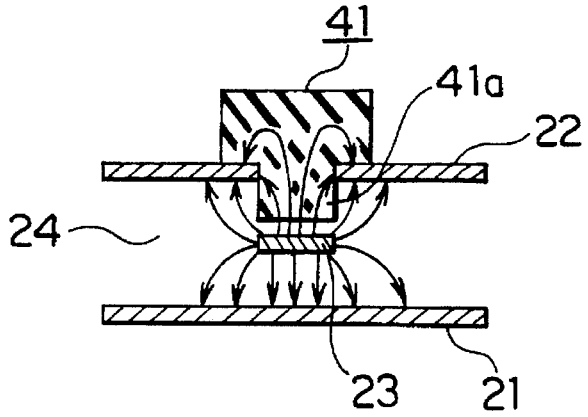
FIG. 11 shows a sectional view of the distribution of an electric field when a dielectric portion is inserted in the window illustrated in FIG. 8.

In FIG. 11, the first dielectric body 41 has a projection portion 41*a* which is inserted from the first window section 31 into the impedance converting device 40. The first window section 31 may be completely covered with the first dielectric body 41. As shown in FIG. 11, the first dielectric body 41 terminates the electric flux passing through the first window section 31. Inasmuch as the first dielectric body 41 has the projection portion 41*a*, it is possible to greatly vary the terminative condition of the electric flux passing through the first window section 31.

Figure 12:
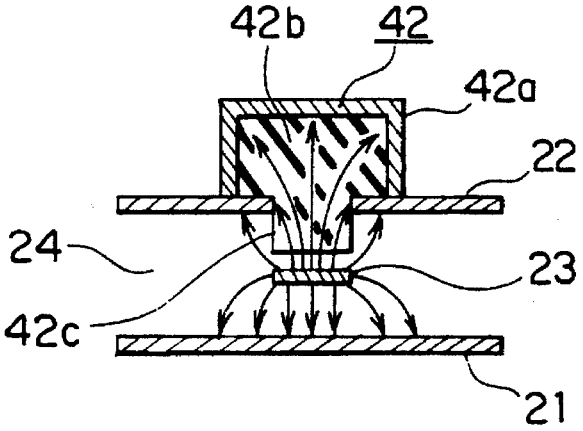
FIG. 12 shows a sectional view of the distribution of an electric field when dielectric portion having a metal case is inserted in the window illustrated in FIG. 8.

In FIG. 12, the second dielectric body 42 has a projection portion 42*c* which is inserted from the third window section 33 into impedance converting device 40. The third window sections 33 may be completely covered with the second dielectric body 42. As shown in FIG. 12, the second dielectric body 42 terminates the electric flux passing through the third window section 33. Because the second dielectric body 42 has projection portion 42*c*, it is possible to greatly vary the terminative condition of the electric flux lines passing through the third window section 33.

What is claimed is:

1. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal and having an inductive reactance element and a capacitive reactance element separate from said inductive reactance element, said impedance converting device further comprising:

varying means for varying a reactance of said line conductor, said varying means comprising a window sections formed in at least one of said first and said second grounded conductor members at a predetermined location of the at least one of said first and said second grounded conductor members, wherein said predetermined location is a location at which said window sections corresponds to at least one of said inductive reactance element and said capacitive reactance element;

wherein said window sections has a window form of a predetermined area and said varying means further comprises altering means for altering said predetermined area into an altered area; and wherein said altering means comprises an additional window sections connected to said window sections for altering said predetermined area into said altered area greater than said predetermined area.

2. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal and having an inductive reactance element and a capacitive reactance element separate from said inductive reactance element, said impedance converting device further comprising:

varying means for varying a reactance of said line conductor, said varying means comprising a window sections formed in at least one of said first and said second grounded conductor members at a predetermined location of the at least one of said first and said second grounded conductor members, wherein said predetermined location is a location at which said window sections corresponds to at least one of said inductive reactance element and said capacitive reactance element;

wherein said window sections has a window form of a predetermined area and said varying means further comprises altering means for altering said predetermined area into an altered area, said altering means comprising a metal portion for covering said window sections to alter said predetermined area into said altered area smaller than said predetermined area, and said metal portion comprising a projection portion which is inserted into said impedance converting device through said window sections.

3. An impedance converting device as claimed in claim 2, wherein said dielectric portion completely covers said section such that said altered area is equal to zero.

4. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal and having an inductive reactance element and a capacitive reactance element separate from said inductive reactance element, said impedance converting device further comprising:

varying means for varying a reactance of said line conductor, said varying means comprising a window sections formed in at least one of said first and said second grounded conductor members at a predetermined location of the at least one of said first and said second grounded conductor members, wherein said predetermined location is a location at which said window sections corresponds to at least one of said inductive reactance element and said capacitive reactance element;

wherein said window sections has a window form of a predetermined area and said varying means further comprises altering means for altering said predetermined area into an altered area; and wherein said altering means comprises a dielectric portion for covering said window sections to alter said predetermined area into said altered area smaller than said predetermined area.

5. An impedance converting device as claimed in claim 4, wherein said dielectric portion comprises a projection portion which is inserted into said impedance converting device through said window section.

6. An impedance converting device as claimed in claim 5, wherein said dielectric portion completely covers said window section such that said altered area is equal to zero.

7. An impedance converting device as claimed in claim 4, wherein said dielectric portion is composed of a conductor case and a dielectric material filling said conductor case, said conductor case having at least one opening surface, the opening surface of said dielectric portion facing said window section.

8. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal, said impedance converting device further comprising:

varying means for varying the reactance of said line conductor, said varying means comprising:

a window sections formed in at least one of said first and said second grounded conductor members at a predetermined location of the at least one of said first and said second grounded conductor members, said window sections having a window form of a predetermined area; and altering means for altering said predetermined area into an altered area, said altering means comprising an additional window sections connected to said window sections for altering said predetermined area into said altered area greater than said predetermined area.

9. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal, said impedance converting device further comprising:

varying means for varying the reactance of said line conductor, said varying means comprising:

a window sections formed in at least one of said first and said second grounded conductor members at a predetermined location of the at least one of said first and said second grounded conductor members, said window sections having a window form of a predetermined area; and altering means for altering said predetermined area into an altered area, said altering means comprising a dielectric portion for covering said window sections to alter said predetermined area into said altered area smaller than said predetermined area.

10. An impedance converting device as claimed in claim 9, wherein said dielectric portion comprises a projection portion which is inserted into said impedance converting device through said window sections.

11. An impedance converting device as claimed in claim 10, wherein said dielectric portion completely covers said window sections such that said altered area is equal to zero.

12. An impedance converting device as claimed in claim 9, wherein said dielectric portion is composed of a conductor case and a dielectric material filling said conductor case, said conductor case having at least one opening surface, the opening surface of said dielectric portion facing said window sections.

13. An impedance converting device comprising a tri-plate structure having a first grounded conductor member, a second grounded conductor member disposed apart from said first grounded conductor member to form a space between said first and said second grounded conductor members, and a line conductor member located in said space for allowing a signal to pass therethrough, said line conductor member generating an electric flux in accordance with said signal and having an inductive reactance element and a capacitive reactance element separate from said inductive reactance element, said impedance converting device further comprising:

varying means for varying a reactance of said line conductor, said varying means comprising a window sections formed in at least one of said first and said second grounded conductor members at a predetermined location of the at least one of said first and said second grounded conductor members, said window sections having a window form of a predetermined area, said varying means further comprising altering means for altering said predetermined area into an altered area, said altering means comprising a metal portion for covering said window sections to alter said predetermined area into said altered area smaller than said predetermined area, said metal portion comprising a projection portion which is inserted into said impedance converting device through said window sections;

wherein said predetermined location is a location at which said window sections corresponds to at least one of said inductive reactance element and said capacitive reactance element.

14. An impedance converting device as claimed in claim 13, wherein said metal portion completely covers said window sections such that said altered area is equal to zero.

* * * * *